US006412146B1

(12) United States Patent
Ramsey et al.

(10) Patent No.: US 6,412,146 B1
(45) Date of Patent: Jul. 2, 2002

(54) ENHANCED DRYER-CLEANER COMBINATION AND PROCESS FOR COTTON GINS

(75) Inventors: L. Todd Ramsey; Randal D. Drennan, both of Lubbock, TX (US)

(73) Assignee: Kimbell Gin Machinery Company, Lubbock, TX (US)

( * ) Notice: Subject to any disclaimer, the term of this patent is extended or adjusted under 35 U.S.C. 154(b) by 0 days.

(21) Appl. No.: 09/774,978

(22) Filed: Jan. 31, 2001

(51) Int. Cl.[7] ..... D01B 1/48
(52) U.S. Cl. ..... 19/0.27; 19/39; 19/65 A
(58) Field of Search ..... 19/0.27, 39, 65 A, 19/65 R, 66 R, 66 CC; 28/100, 299; 34/210; 68/5 D, 5 E; 241/160, 280, 281

(56) References Cited

U.S. PATENT DOCUMENTS 1,942,868 A * 1/1934 Mitchell ..... 19/0.27
1,962,320 A * 6/1934 Mitchell ..... 19/0.27
1,988,629 A * 1/1935 Mitchell ..... 19/0.27
2,025,701 A * 12/1935 Mitchell ..... 19/0.27
2,096,208 A * 10/1937 Streun ..... 19/0.27
2,214,680 A * 9/1940 Sims ..... 19/0.27
2,820,306 A * 1/1958 Smith ..... 19/0.27
2,883,709 A * 4/1959 Deems et al. ..... 19/0.27
3,069,730 A * 12/1962 Vandergriff ..... 19/0.27
4,535,510 A * 8/1985 Shoham ..... 19/0.27

OTHER PUBLICATIONS

Cotton Ginners Handbook published by USDA Agricultural Research Service as Agricultural Handbook No. 503, Dec. 1994.

* cited by examiner

*Primary Examiner*—Danny Worrell
*Assistant Examiner*—Gary L. Welch

(57) ABSTRACT

This application discloses an improved dryer-cleaning apparatus for use in a cotton gin. It includes a dryer having rotating paddle cylinders for moving the cotton through the dryer and then discharging the cotton directly into the cleaner without compaction or entrapment of the trash within the raw cotton.

8 Claims, 4 Drawing Sheets

ENHANCED DRYER-CLEANER COMBINATION AND PROCESS FOR COTTON GINS

FIELD OF INVENTION

This invention is an improved dryer-cleaner apparatus and process having a primary use and benefit in cotton gins. The combination apparatus is intended to be positioned in a cotton gin adjacent the beginning of the ginning process for the purposes of enhancing the drying of the raw cotton and more efficiently removing trash. The ultimate goals are to increase output or "turnout" and to improve the quality or grade of the final cotton product. The invention also includes a new and novel design for grid fingers for the dryer that enhances the separation of trash from the cotton and minimizes the possibility of clogging of the dryer by the trash or cotton.

BACKGROUND OF INVENTION

Cotton gins are the physical facilities that receive raw field seed cotton, its burrs and seed as well as dirt, plant stems, leaves and other trash for processing into a clean cotton fiber which is then baled for shipment to a textile plant. The existing processes and equipment contained in modern cotton gins are well depicted in the *Cotton Ginners Handbook*, Agricultural Handbook No. 503, of the United States Department of Agriculture, December 1994, the contents of which are incorporated herein by reference as if fully set forth herein in accord with the provisions of MPEP §608.01(p)[R-1].

The conventional ginning process is summarily illustrated in FIG. 1 which is labeled "Prior Art." It depicts a module 12 of field seed cotton bolls that were compacted in the field and brought to the cotton gin. A module feeder (not shown) fragments and disperses the compacted cotton 12 into the individual bolls and transmits them through a large diameter pipe and a rock and green boll trap (not shown) for delivery to a dryer 16. Prior to reaching the dryer 16, heated air from a fan and heater is also delivered to the cotton within the pipe. The purpose of the drying is to reduce the moisture content of the raw cotton to facilitate subsequent cleaning and removal of trash. This dried cotton is then drawn into another air duct for delivery to one (or, in many cases, two) cleaners 20 which remove a portion of the burrs, stems and other trash. As depicted, the cleaner 20 is an overhead, inclined cylinder type, although other types are used in various gins. These overhead cleaners 20 remove much of the trash from the cotton before it is passed to a stick or stick and burr extractor (not shown) that removes additional burrs, stems, and trash. From the extractor, additional heated air may be added to the system to dry the cotton down to a 6 or 7% moisture level before it reaches the gin stand 22 which separates the cotton fiber from the seed. From the gin stand 22, the cotton fiber is drawn into a pneumatic conveyor for transfer to one or more lint cleaners 24 which have the job of removing the remaining pin trash from the cotton before it is baled in the press 26.

In this typical gin process, it is well known that the lint cleaners, in removing the trash, break some of the fiber which becomes a fuzz like substance called motes that is removed with the trash. In addition, some of the broken fiber is not separated, but is carried to the bale press. The resulting known problems includes a fiber loss as well as a reduction in the grade of the cotton due to a shorter fiber length. Consequently, if more trash could be earlier removed so that the use of the lint cleaners could be reduced or minimized, both fiber output and cotton grade could be enhanced.

Another problem in this typical process results from the fact that after the drying step, the raw cotton is immediately transferred back into a high pressure, pnuematic conduit in which it is compacted. This compaction of the cotton results in further entrapment of the cotton trash within the fiber and renders the inclined cylinder cleaners less efficient thereby increasing the need for and use of the lint cleaners. The compaction also results is carrying trash through several additional steps to the lint clearer so as to increase the wear on the machinery and increase the horsepower requirements of the process.

SUMMARY OF INVENTION

To solve or minimize the above identified problems, the present invention includes a combination dryer-cleaner that enhances the trash removal problem at the beginning of the ginning process and minimizes the need for or use of multiple saw-type lint cleaners. Specifically, the combination includes a single unit dryer-cleaner assembly that enables the cotton to be more efficiently dried and then transmitted from the dryer to the cleaner without the use of piping, conduits or conveyers which would entrap the trash and render the cleaning far more difficult. The dryer-cleaner unit also includes a novel design of T shaped grid bars that enhance the drying process and avoid clogging of the air passages so as to maximize air flow and drying.

Accordingly, the objectives of this invention are to provide a product and process that solves the above identified problems and achieves one or more of the following results:

1. avoids compacting the cotton and entrapping trash therein after it has been dried for ginning;
2. enhances moisture removal and increases the drying efficiency by breaking apart compressed wads of field cotton and exposing more surface area;
3. more efficiently removes trash from the cotton at the beginning of the ginning process;
4. reduces waste and increases the quantity of cotton fiber obtained from the raw cotton;
5. reduces and minimizes the need to use lint cleaners which damage fiber length and quality and impose higher power requirements upon the ginning process;
6. reduces the wear upon fans and conduits and reduces the power requirements for ginning cotton by early removal of trash in the ginning process; and
7. improves the quality and grade of the cotton processed by the cotton gin.

DESCRIPTION OF THE DRAWINGS

The manner in which these objectives and other desirable characteristics can be obtained from this invention is explained in the following specification and attached drawings in which.

DETAILED DESCRIPTION

Figure 1:
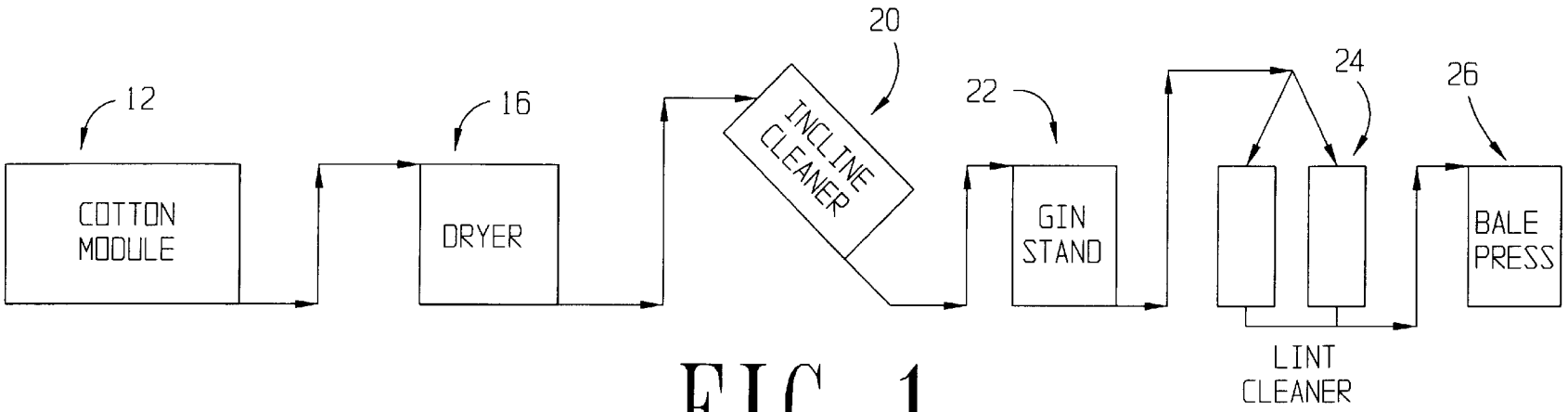
FIG. 1 is a process diagram illustrating the prior art process of ginning of cotton.
Figure 2:
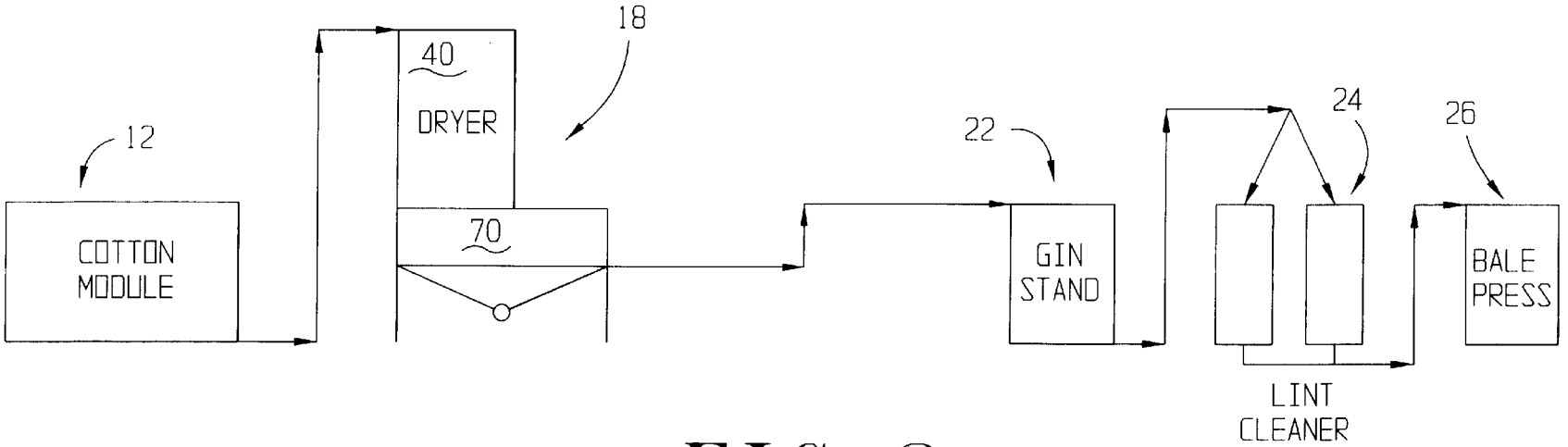
FIG. 2 is a process diagram illustrating the preferred process of our invention which is a modification of the process of FIG. 1.
Figure 3:
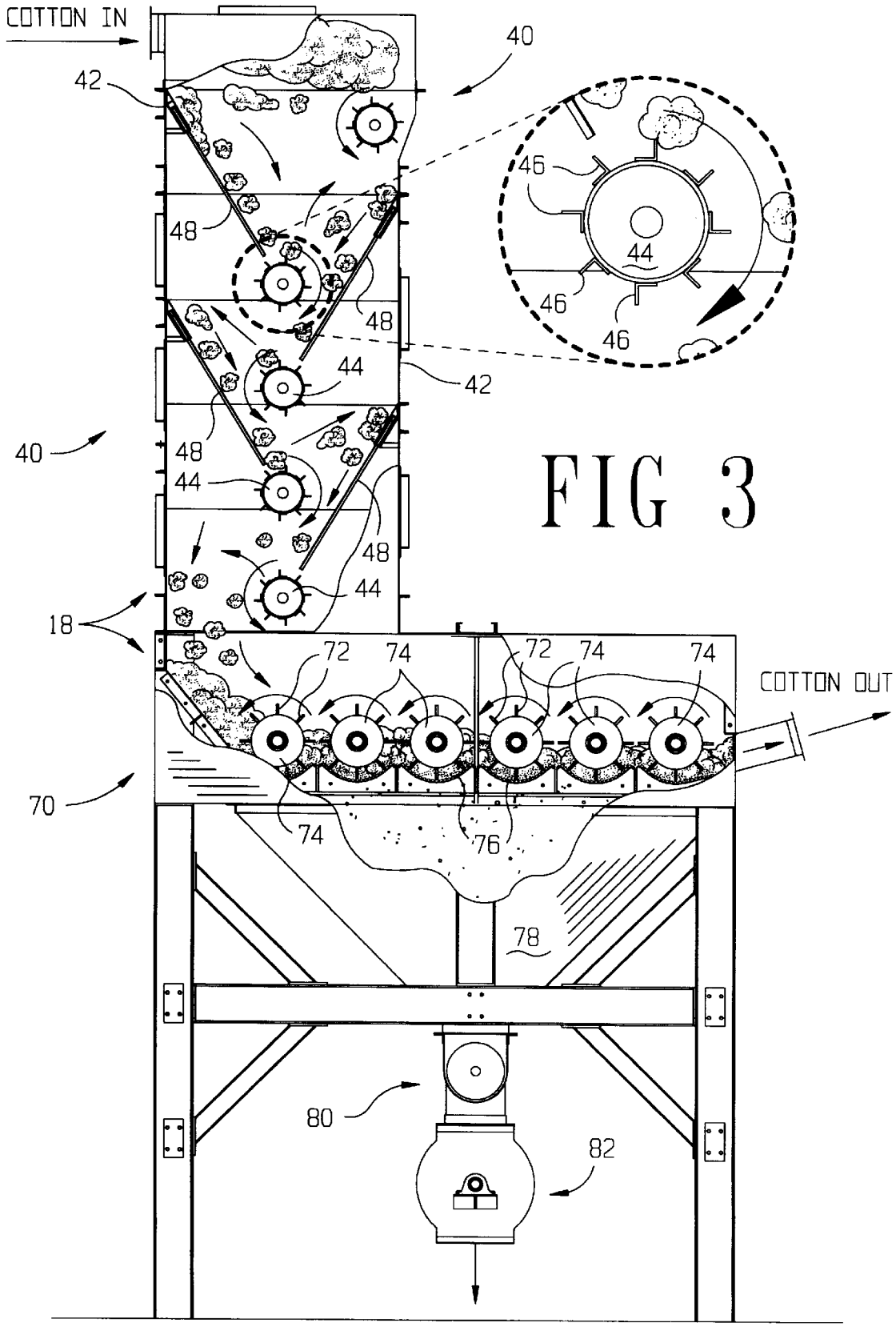
FIG. 3 is a side elevational view, partially in section, of a preferred embodiment of the combination dryer-cleaner of our invention.

The preferred embodiment of this invention is depicted in a schematic diagram of FIG. 2 which has some similarities to that of FIG. 1 labeled "Prior Art." As in the prior art, the ginning process of this embodiment begins with the module feeder 12 or suction shed in which the raw field seed cotton is delivered to piping for transfer to the dryer-cleaner unit 18 of our invention. As in the prior art standard practice, heated air is forced into the piping just ahead of the dryer which in this case is a combination 18 of a vertical dryer 40 mounted upon a horizontal cleaner 70. This unit is best depicted in FIG. 3.

The dryer 40 comprises a rectangular housing 42 that receives raw cotton from pneumatic piping at its top section and discharges it at the bottom into the horizontal cleaner 70. The cotton comes into the housing 42 with a high volume and velocity of heated air and is dried as it passes downward to the cleaner 70 at the bottom of the dryer 40. As the cotton is blown into the cleaner 70, it engages a first rotating, wad busting elongated cylinder 44 which breaks up and disperses any remaining compacted wads of cotton into individual bolls and thrusts the cotton bolls against an adjacent inclined grid bar shelf 48 upon which it slides down to engage another wad busting cylinder 44 having paddles 46 formed of angle iron welded thereto. During this drying process, the cotton is repeatedly thrust against the upper end of each of the grid bar shelves 48 upon which it slides downward to be engaged by the next cylinder paddle 46 and is again thrust over and upward towards the top of the next shelf 48 as depicted in FIG. 3. The resulting circuitous route of the descending cotton assists in the removal of moisture and in dislodging embedded trash. As the cotton slides down the shelves 48 towards the cylinders 44, air is permitted to pass through the cotton bolls and through elongated spaces 51 formed in the shelves 48. This enhances the drying of the cotton.

Figure 4:
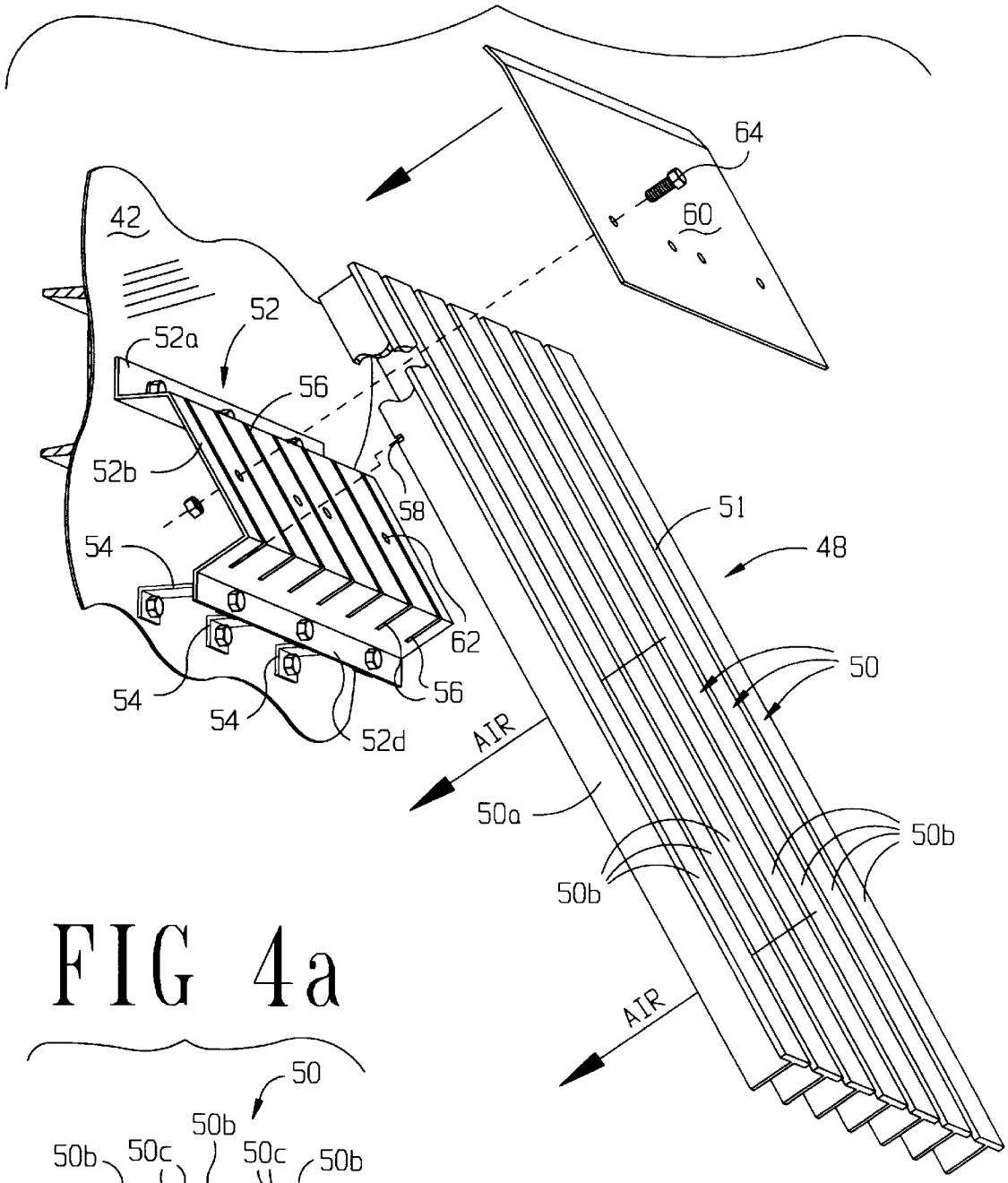
FIG. 4 is a perspective view of a preferred embodiment of our grid bar improvement to the dryer element of our invention.

FIG. 4 illustrates the details of a preferred embodiment of the shelves 48 that facilitates this drying function. Each shelf 48 is comprised of a plurality of parallel, spaced apart T beam grids 50. They depend downwardly at an angle of about 60 degrees from the interior wall of the housing 42 of the dryer and are cut so as to terminate just above an associated paddle cylinder 44. Preferably, these T beams 50 are economically formed of extruded aluminum and have a substantial resistance to bending deflection by virtue of the web section 50*a* depending from the flange or deck top 50*b* above the web.

The T bars are economically and simplistically mounted to the wall of the housing 42 by a primary bracket 52 and spacer brackets 54. The primary bracket 52 has a flange 52*a* that is affixed to the walls of the housing 42 by bolts as shown in FIG. 4. From the wall, the bracket extends inwardly and then downwardly at a 60 degree angle. This downward support section 52*b* provides an elongated support for the bottom surfaces of the flange 50*b* of the T beams 50. At the lower end of the downward support section 52*b*, the bracket is bent back towards the wall of the housing 42 and then terminates in another flange 52*d*. A plurality of lower spacer brackets 54 support the flange 52*d* away from the wall to maintain the 60 degree angle of the support section 52*b* with respect to the wall of the housing 42.

The primary bracket 52 is provided with elongated slots 56 which receive the web 50*a* of the T bars and permit the bottom surfaces of the deck or flange 50*b* to engage and rest against the support section 52*b* of the bracket 52. A notch 58 on the web 50*a* of the T beam engages the end of the elongated slot 56 to restrain the T bar against sliding movement down the surface. Finally, a locking plate 60 with apertures is used to lock the top end of the T beams 50 against pivotal movement about notch 58 and to maintain them in place. To facilitate attachment of the locking plate 60, the apertures 62 may be threaded. Alternatively, locking nuts 64 may be used as shown in FIG. 4.

Figure 4A:
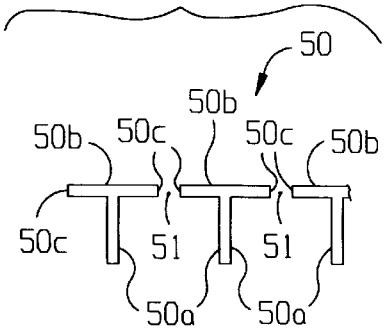
FIG. 4*a* is an elevational view depicting the spacing of the T beams used to form the shelves within the dryer.

As shown in FIG. 4*a*, the flanges 50*b* have squared edges 50*c* and are spaced apart to permit the air to freely flow there through. We have found that the squared edges 50*c* minimize clogging of the spaces 51 between the T beams by either cotton or trash—a fact that results in better air flow through the cotton and the spaces and results in improved drying.

By the time the cotton has reached the bottom of the dryer, its moisture has been reduced and the trash has, at this point in the process, the least tendency to cling to the cotton. Consequently, we have discovered that much of the trash can be best removed from the cotton by directly running it through a cleaner 70 and without re-compacting the cotton and trash by transferring it to a distant cleaner through piping. To that end, and as shown in FIG. 3, the cleaner 70 of our invention is positioned directly below the dryer 40. Other than positioning and having a large access opening to the dryer 40 within the system, the cleaner 70 may be a conventional multi-cylinder horizontal line cleaner having a plurality of spike cylinders 74 that extend to the outside of the housing where they are rotatably driven by a belt and pulley system.

Preferably, the access opening between the dryer 40 and the cleaner 70 extends for the entire width of the dryer 40 and across at least one third of its length. As shown in FIG. 3, the cotton and any associated trash flows downward past the left side of the bottom paddle cylinder and into the cleaner 70 in an unobstructed manner and without compaction.

Upon reaching the cleaner 70, the cotton is picked up by the spikes 72 on a conventional rotating spike cylinder 74 and is dragged across a plurality of spaced apart elongated cylinder grid bars 76 which are preferably arranged to define semi-circular pattern of a radius just greater than that of the spikes 72 of the cylinders 74. The cotton is dragged across the grid bars 76 so that any trash associated with the cotton then drops through the spaced apart bars 76 and falls downward into a hopper 78. As is customary in the art of cylinder cleaners, a plurality of cylinders 74 are provided. Preferably, the hopper 78 terminates in an auger type conveyer 80 that carries the trash to a rotary airlock 82. This rotary air lock 82 passes the accumulated trash out of the hopper.

Figure 5:
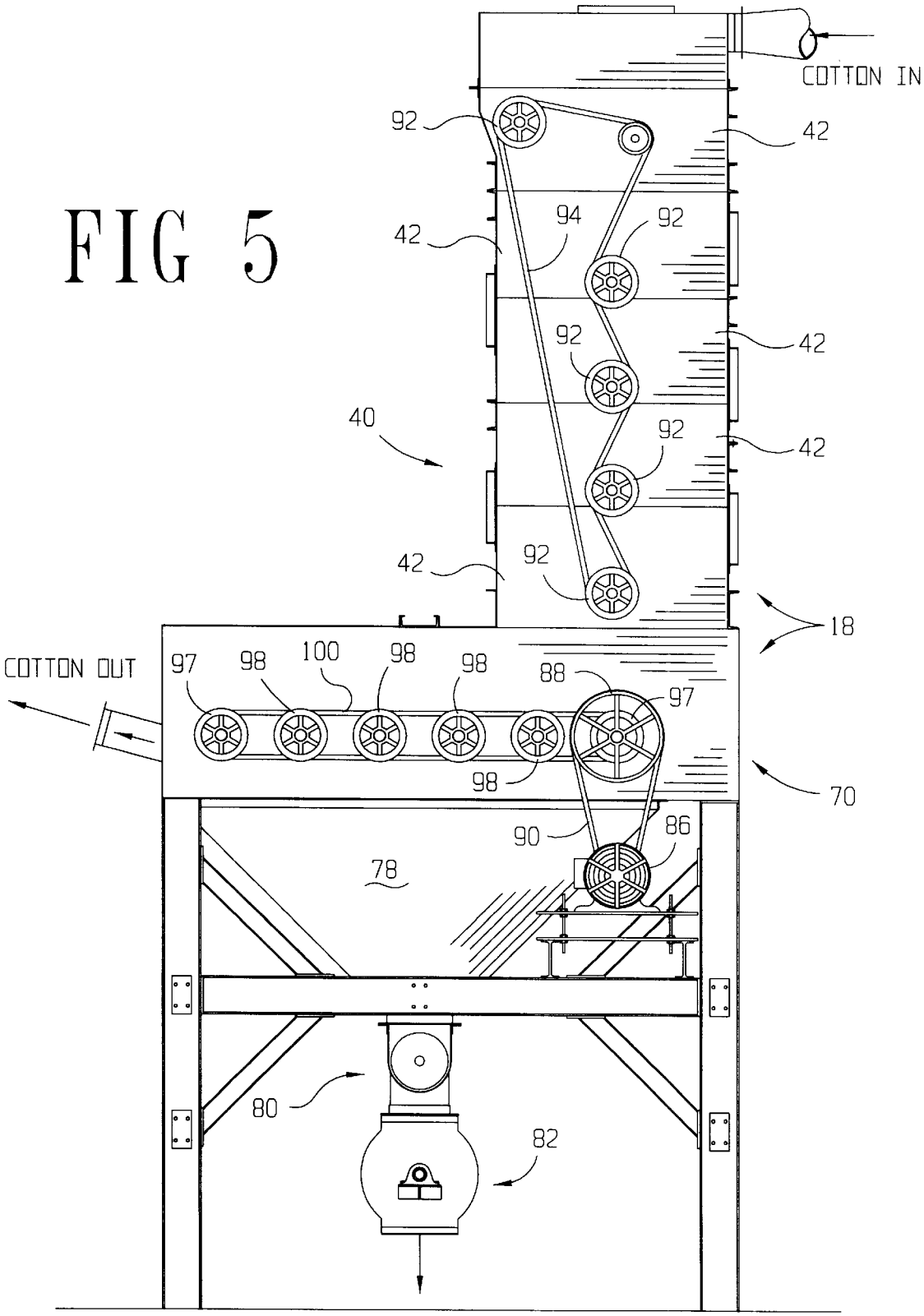
FIG. 5 is a side elevational view of the far or opposite side of the preferred embodiment of FIG. 3 depicting the pulleys and drive belts for driving the dryer and cleaner.

The side of the dryer-cleaner opposite to that of FIG. 3 is depicted in FIG. 5. It illustrates one concept for supplying power to the dryer 40 and cleaner 70. That power is supplied through a motor 86 which is connected by belt 90 to a pulley 88 that is constrained for rotation with the shaft (unnumbered) of the first spike cylinder 74. A first, single pulley wheel 97 is also constrained for rotation with this shaft and, through a series of short belts 100 and a plurality of double pulley wheels 98, drives each of the spike cylinders 74 of the cleaner 70. The last spike cylinder 74 is driven by a single pulley 97 and a single belt because further transmission of the rotational motion is not needed.

The rotary motion of the first spike cylinder 74 of the cleaner also carries a pulley wheel on the opposite side which is tied to a first pulley wheel 92 of the lower wad busting cylinder 44. This belt is not shown because the pertinent portion of FIG. 3 was broken away to depict the internal portion of the cylinders. As earlier mentioned, however, the lower wad busting cylinder 44 carries a single belt 94 that is serpentined through pulley wheels 92 of each of the other wad busting cylinders 44 and an idler pulley which is unnumbered. Thus, a single motor 86 supplies rotary power to the entire dryer-cleaner unit 18.

Those skilled in the art will appreciate that this invention may take many forms. For example, instead of using the inclined shelf cleaner of FIG. 4, one could use a horizontal shelf cleaner—and still meet the invention's objective of avoiding compaction and entrapment of the trash in the cotton. In addition, the dryer and cleaner could be separated by a distance as long as an enlarged, preferably rectangular ducting were used to convey the cotton from the dryer to the cleaner without compaction or further entrapment of trash. Similarly, the dryer's T-beam shelves could be supported with different brackets and at different angles other than that disclosed in the preferred embodiment. Finally, other types of cleaners could be used below the dryer as a substitute for the horizontal cleaner disclosed. Those skilled in the art will appreciate that the width of the dryer-cleaner, the number of cylinders as well as the rotary speed of the unit are design variables that, at least in part, will be dependent upon the anticipated capacity of the entire gin equipment.

We claim:

1. A combination dryer-cleaner apparatus for a cotton gin for enhancing the drying function and cleaning function of seed cotton while reducing damage to the fiber of said seed cotton, the apparatus comprising:

a) a dryer for receiving raw field cotton, said dryer having a housing and at least one rotating cylinder for busting any compacted wads of field cotton and for dispersing the field cotton into individual bolls and thrusting them upon at least one inclined shelf to enhance drying, said dryer also having a circuitous route for transferring the cotton to a cleaner to enhance drying;

b) a cleaner having a plurality of cylinders for dragging the seed cotton across associated grid bars for separating trash from the raw cotton; and c) said dryer being mounted upon said cleaner and communicating therewith through an unrestricted opening to permit immediate and substantially unrestricted transfer of the raw cotton from the dryer to the cleaner to effectuate cleaning before the trash recombines with the cotton and while it is remains in a heated condition when trash separation is enhanced.

2. An apparatus as recited in claim 1 in which said dryer has a plurality of depending shelves and a plurality of rotating cylinders for thrusting the cotton against an adjacent depending shelf to define the circuitous route for the descending cotton to enhance moisture removal.

3. An apparatus as recited in claim 2 in which said shelf is formed of spaced apart T shaped grid beams extending downwardly from the dryer housing.

4. An apparatus as recited in claim 3 in which said T beams have square edges to inhibit the collection of trash in the spaces between the T beams.

5. An apparatus as recited in claim 1 in which said dryer is vertical and has a plurality of vertically spaced cylinders and associated paddles thrusting said cotton into a circuitous route to enhance the drying.

6. An apparatus as recited in claim 1 in which said cleaner has a plurality of rotatable horizontally spaced spike cylinders spaced above grid bars through which trash may pass for removal from the cotton.

7. An improved combined process of reducing the moisture level of raw seed cotton and of cleaning said cotton, said process comprising the steps of:

a) directing raw seed cotton in an air stream to a vertical dryer;

b) impacting said seed cotton to break any wads into individual bolls and to thrust them upon at least one inclined shelf to provide a circuitous route for said bolls to further reduce moisture;

c) substantially reducing the moisture level of the raw seed cotton to approximately 5% in the dryer;

d) transferring the cotton from the dryer to a cylinder cleaner without compaction or entanglement of trash with the raw seed cotton and passing said seed cotton through a series of cylinder cleaners to enhance the cleaning function of the cleaner.

8. A process as recited in claim 7 in which includes the step of:

a) causing the raw cotton to pass through a circuitous route as it passes through the dryer to enhance the removal of moisture and to loosen the trash therefrom.

* * * * *